US005308473A

United States Patent [19]

Markham et al.

[11] Patent Number: 5,308,473

[45] Date of Patent: May 3, 1994

[54] LOW $NO_x$ FCC REGENERATION PROCESS AND APPARATUS

[75] Inventors: Catherine L. Markham; Gregory P. Muldowney, both of Glen Mills, Pa.

[73] Assignee: Mobil Oil Corporation, Fairfax, Va.

[21] Appl. No.: 946,700

[22] Filed: Sep. 18, 1992

[51] Int. Cl.[5] ..... C10G 11/18

[52] U.S. Cl. ..... 208/113; 208/152; 208/254 R; 502/42

[58] Field of Search ..... 208/113, 152, 254 R; 502/42, 41

[56] References Cited

U.S. PATENT DOCUMENTS

| | | | |
|---|---|---|---|
| 4,317,798 | 3/1982 | Worley | 502/42 |
| 4,755,282 | 7/1988 | Samish et al. | 208/113 |
| 4,810,360 | 3/1989 | Haddad et al. | 208/152 |
| 4,853,107 | 8/1989 | Haddad et al. | 208/152 |
| 4,980,048 | 12/1990 | Leib et al. | 208/113 |
| 5,047,140 | 9/1991 | Owen et al. | 502/43 |
| 5,130,012 | 7/1992 | Edwards et al. | 502/42 |

*Primary Examiner*—Anthony McFarlane

*Attorney, Agent, or Firm*—Alexander J. McKillop; Malcolm D. Keen; Richard D. Stone

[57] ABSTRACT

A process and apparatus for fluidized bed regeneration of FCC catalyst are disclosed. Oxides of nitrogen ($NO_x$) emissions from an FCC regenerator operating in complete CO combustion mode, and hydrothermal catalyst deactivation, are reduced by reducing the average bed temperature. Dilute phase afterburning superheats catalyst entrained in the dilute phase region above the fluidized bed. Cyclone separators recover superheated, entrained catalyst and preferentially recycle this catalyst to the FCC reactor, permitting cooler operation of the dense phase fluidized bed.

17 Claims, 2 Drawing Sheets

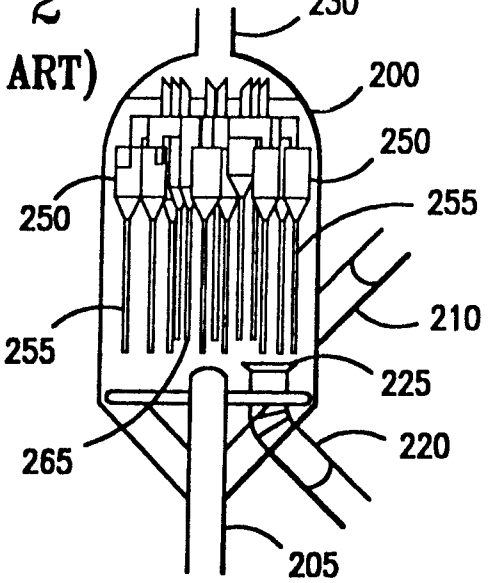
FIG. 2
(PRIOR ART)
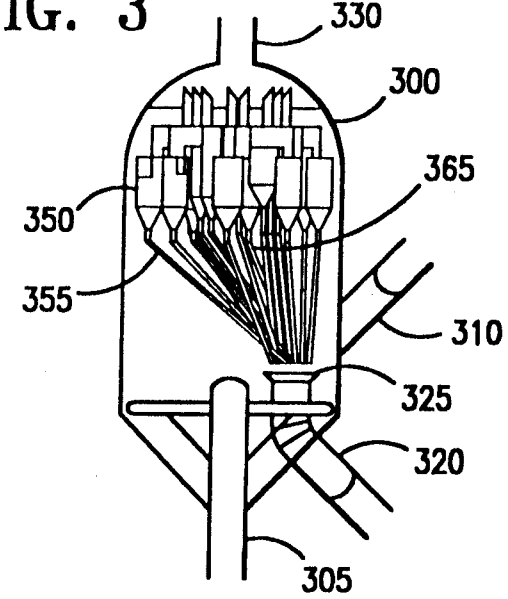
FIG. 3
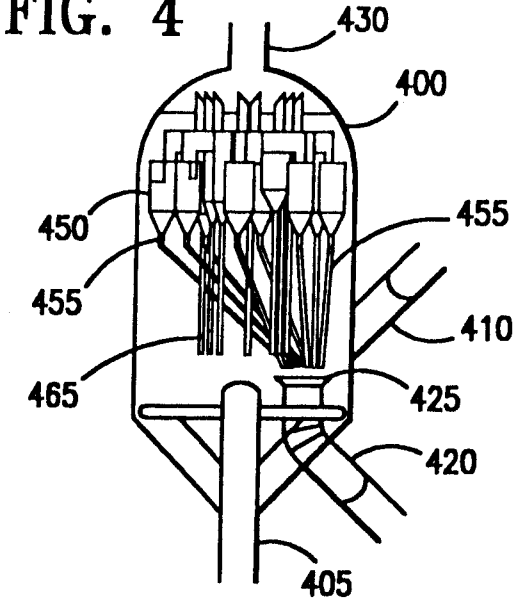
FIG. 4
FIG. 2A
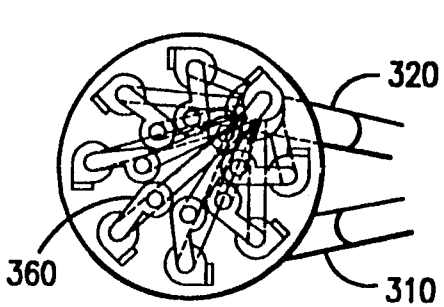
FIG. 3A
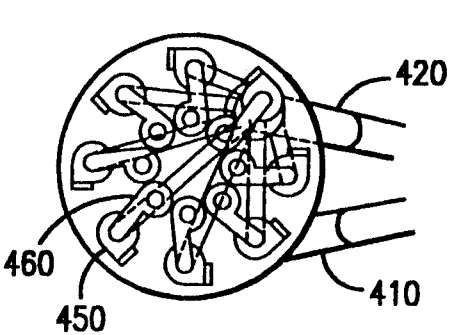
FIG. 4A

LOW $NO_x$ FCC REGENERATION PROCESS AND APPARATUS

BACKGROUND OF THE INVENTION

1. Field of the Invention

The invention relates to catalytic reduction of oxides of nitrogen, $NO_x$, produced in catalytic cracking unit regenerators operating in complete CO combustion mode.

2. Description of Related Art $NO_x$, or oxides of nitrogen, in flue gas streams from FCC regenerators operating in complete CO burn mode is a pervasive problem. FCC units process heavy feeds containing nitrogen compounds, and much of this material is eventually converted into $NO_x$ emissions. There may be some nitrogen fixation, or conversion of nitrogen in regenerator air to $NO_x$, but most of the $NO_x$ in the regenerator flue gas is believed to come from oxidation of nitrogen compounds in the feed.

Several powerful ways have been developed to deal with the problem. The approaches fall into roughly five categories:

1. Feed hydrotreating, to keep $NO_x$ precursors from the FCC unit.
2. Segregated cracking of fresh feed.
3. Process approaches which reduce the amount of $NO_x$ formed in a regenerator via regenerator modifications.
4. Catalytic approaches, using a catalyst or additive which is compatible with the FCC reactor, which suppress $NO_x$ formation or catalyze its reduction.
5. Stack gas cleanup methods which are isolated from the FCC process.

The FCC process will be briefly reviewed, followed by a review of the state of the art in reducing $NO_x$ emissions, and hydrothermal catalyst deactivation.

FCC PROCESS

Catalytic cracking of hydrocarbons is carried out in the absence of externally supplied H2, in contrast to hydrocracking, in which H2 is added during the cracking step. An inventory of particulate catalyst is continuously cycled between a cracking reactor and a catalyst regenerator. In the fluidized catalytic cracking (FCC) process, hydrocarbon feed contacts catalyst in a reactor at 425° C.–600° C., usually 460° C.–560° C. The hydrocarbons crack, and deposit carbonaceous hydrocarbons or coke on the catalyst. The cracked products are separated from the coked catalyst. The coked catalyst is stripped of volatiles, usually with steam, and is then regenerated. In the catalyst regenerator, the coke is burned from the catalyst with oxygen-containing gas, usually air. Coke burns off, restoring catalyst activity and simultaneously heating the catalyst to, e.g., 500° C.–900° C., usually 600° C.–750° C. Flue gas formed by burning coke in the regenerator may be treated for removal of particulates and for conversion of carbon monoxide, after which the flue gas is normally discharged into the atmosphere.

Most FCC units now use zeolite-containing catalyst having high activity and selectivity. These catalysts are generally believed to work best when the amount of coke on the catalyst after regeneration is relatively low.

Many FCC units operate in complete CO combustion mode, i.e., the mole ratio of $CO_2/CO$ is at least 10. Refiners try to burn CO completely within the catalyst regenerator to conserve heat and to minimize air pollution. Among the ways suggested to decrease the amount of carbon on regenerated catalyst and to burn CO in the regenerator is to add a CO combustion promoter metal to the catalyst or to the regenerator.

Metals have been added as an integral component of the cracking catalyst and as a component of a discrete particulate additive, in which the active metal is associated with a support other than the catalyst. U.S. Pat. No. 2,647,860 proposed adding 0.1 to 1 weight percent chromic oxide to a cracking catalyst to promote combustion of CO. U.S. Pat. No. 3,808,121, taught using relatively large-sized particles containing CO combustion-promoting metal into a cracking catalyst regenerator. The circulating particulate solids inventory, of small-sized catalyst particles, cycled between the cracking reactor and the catalyst regenerator, while the combustion-promoting particles remain in the regenerator.

U.S. Pat. Nos. 4,072,600 and 4,093,535 teach use of combustion-promoting metals such as Pt, Pd, Ir, Rh, Os, Ru and Re in cracking catalysts in concentrations of 0.01 to 50 ppm, based on total catalyst inventory. This approach is so successful that most FCC units use Pt CO combustion promoter. This reduces CO emissions, but usually increases nitrogen oxides ($NO_x$) in the regenerator flue gas.

It is difficult in a catalyst regenerator to completely burn coke and CO in the regenerator without increasing the $NO_x$ content of the regenerator flue gas. Many jurisdictions have passed legislation restricting the amount of $NO_x$ that can be in a flue gas stream discharged to the atmosphere. In response to environmental concerns, much effort has been spent on finding ways to reduce $NO_x$ emissions.

FEED HYDROTREATING

Some refiners now go to the expense of hydrotreating feed. This is usually done more to meet sulfur specifications in various cracked products, or a $SO_x$ limitation in regenerator flue gas rather than a $NO_x$ limitation. Hydrotreating will reduce to some extent the nitrogen compounds in FCC feed, and this will help reduce the $NO_x$ emissions from the regenerator.

SEGREGATED FEED CRACKING

U.S. Pat. No. 4,985,133, Sapre et al, which is incorporated by reference, taught that refiners processing multiple feeds could reduce $NO_x$ emissions, and improve performance in the cracking reactor, by keeping high and low nitrogen feeds segregated, and adding them to different elevations in the FCC riser.

PROCESS APPROACHES TO $NO_x$ CONTROL

Process modifications are suggested in U.S. Pat. No. 4,413,573 and U.S. Pat. No. 4,325,833 directed to two- and three-stage FCC regenerators, which reduce $NO_x$ emissions.

U.S. Pat. No. 4,313,848 teaches countercurrent regeneration of spent FCC catalyst, without backmixing, to minimize $NO_x$ emissions.

U.S. Pat. No. 4,309,309 teaches the addition of a vaporizable fuel to the upper portion of a FCC regenerator to minimize $NO_x$ emissions. Oxides of nitrogen formed in the lower portion of the regenerator are reduced in the reducing atmosphere generated by burning fuel in the upper portion of the regenerator.

U.S. Pat. No. 4,542,114 taught minimizing the volume of flue gas by using oxygen rather than air in the FCC regenerator, with consequent reduction in the amount of flue gas produced.

In Green et al, U.S. Pat. No. 4,828,680, which is incorporated herein by reference, the level of $NO_x$ emissions from a FCC unit was reduced by incorporating carbonaceous particles such as sponge coke or coal into the circulating inventory of cracking catalyst. The carbonaceous particle performed several functions, selectively absorbing metal contaminants in the feed and also reducing $NO_x$ emissions in certain instances. Many refiners are reluctant to add coal or coke to their FCC units, and such carbonaceous materials will also burn, and increase the heat release in the regenerator. Most refiners would prefer to reduce, rather than increase, heat release in their regenerators.

DENOX WITH COKE

U.S. Pat. No. 4,991,521, Green and Yan, showed that a regenerator could be designed so that coke on spent FCC catalyst could be used to reduce $NO_x$ emissions from an FCC regenerator. The patent disclosed a two stage FCC regenerator, wherein flue gas from a second stage of regeneration contacted coked catalyst. Although effective at reducing $NO_x$ emissions, this approach is not readily adaptable to existing units.

DENOX WITH REDUCING ATMOSPHERES

Another process approach to reducing $NO_x$ emissions from FCC regenerators is to create a relatively reducing atmosphere in some portion of the regenerator by segregating the CO combustion promoter. Reduction of $NO_x$ emissions in FCC regenerators was achieved in U.S. Pat. Nos. 4,812,430 and 4,812,431 by using a conventional CO combustion promoter (Pt) on an unconventional support which permitted the support to segregate in the regenerator. Use of large, hollow, floating spheres gave a sharp segregation of CO combustion promoter in the regenerator. Disposing the CO combustion promoter on fines, and allowing these fines to segregate near the top of a dense bed, or to be selectively recycled into the dilute phase above a dense bed, was another way to segregate the CO combustion promoter.

CATALYTIC APPROACHES TO $NO_x$ CONTROL

The work that follows is generally directed at special catalysts which promote CO afterburning, but which do not promote formation of as much $NO_x$.

U.S. Pat. Nos. 4,300,997 and 4,350,615, are both directed to use of Pd-Ru CO-combustion promoter. The bi-metallic CO combustion promoter is reported to do an adequate job of converting CO to $CO_2$, while minimizing the formation of $NO_x$.

U.S. Pat. No. 4,199,435 suggests steam treating conventional metallic CO combustion promoter to decrease $NO_x$ formation without impairing too much the CO combustion activity of the promoter.

U.S. Pat. No. 4,235,704 suggests too much CO combustion promoter causes $NO_x$ formation, and calls for monitoring the $NO_x$ content of the flue gases, and adjusting the concentration of CO combustion promoter in the regenerator based on the amount of $NO_x$ in the flue gas. As an alternative to adding less CO combustion promoter the patentee suggests deactivating it in place, by adding something to deactivate the Pt, such as lead, antimony, arsenic, tin or bismuth.

U.S. Pat. No. 5,002,654, Chin, which is incorporated by reference, taught the effectiveness of a zinc based additive in reducing $NO_x$. Relatively small amounts of zinc oxides impregnated on a separate support having little or no cracking activity produced an additive which could circulate with the FCC equilibrium catalyst and reduce $NO_x$ emissions from FCC regenerators.

U.S. Pat. No. 4,988,432 Chin, incorporated by reference, taught the effectiveness of an antimony based additive at reducing $NO_x$.

Many refiners are reluctant to add additional metals to their FCC units out of environmental concerns. One concern is that some additives, such as zinc, may vaporize under some conditions experienced in FCC units. Many refiners are concerned about adding antimony to their FCC catalyst inventory.

Such additives would also add to the cost of the FCC process and would dilute the FCC equilibrium catalyst to some extent.

Considerably effort has been spent on downstream treatment of FCC flue gas. This area will be briefly reviewed.

STACK GAS TREATMENT

It is known to react $NO_x$ in flue gas with $NH_3$. $NH_3$ is a selective reducing agent, which does not react rapidly with the excess oxygen which may be present in the flue gas. Two types of $NH_3$ process have evolved, thermal and catalytic.

Thermal processes, such as the Exxon Thermal DENOX process, generally operate as homogeneous gas-phase processes at very high temperatures, typically around 1550°-1900° F. More details of such a process are disclosed by Lyon, R. K., Int. J. Chem. Kinet., 3, 315, 1976, which is incorporated herein by reference.

The catalytic systems which have been developed operate at much lower temperatures, typically at 300°-850° F. These temperatures are typical of flue gas streams. Unfortunately, the catalysts used in these processes are readily fouled, or the process lines plugged, by catalyst fines which are an integral part of FCC regenerator flue gas.

U.S. Pat. No. 4,521,389 and U.S. Pat. No. 4,434,147 disclose adding $NH_3$ to $NO_x$-containing flue gas to catalytically reduce the $NO_x$ to nitrogen.

U.S. Pat. No. 5,015,362, Chin, which is incorporated by reference, taught reducing $NO_x$ emissions by contacting flue gas with sponge coke or coal, and a catalyst effective for promoting reduction of $NO_x$ in the presence of such carbonaceous substances.

None of the approaches described above provides the perfect solution.

Feed pretreatment is expensive, and can usually be justified only for sulfur removal. Segregated cracking of feed is a significant benefit, but requires that a refiner have separate high and low nitrogen feeds available.

Process approaches, such as multi-stage or countercurrent regenerators, reduce $NO_x$ emissions but require extensive rebuilding of the FCC regenerator.

Various catalytic approaches, e.g., addition of lead or antimony, as taught in U.S. Pat. No. 4,235,704, to degrade the efficiency of the Pt function may help some but still may fail to meet the ever more stringent $NO_x$ emissions limits set by local governing bodies.

Stack gas cleanup methods are powerful, but the capital and operating costs are high.

HYDROTHERMAL CATALYST DEACTIVATION

In addition to the $NO_x$ problems, which are formidable, the FCC regenerators also act as catalyst steamers.

All FCC regenerators have significant amounts of steam in them (entrained stripping steam, water of combustion from hydrogen rich hydrocarbons). Bubbling dense bed regenerators are the worst offenders, as these units require a large catalyst inventory in the regenerator, and all steam in the regenerator passes through the dilute phase region above the bubbling dense bed.

Many bubbling dense bed regenerators have steam partial pressures of 2-7 psi, with most having steam partial pressures around 3-5 psi.

Bubbling dense bed regenerators suffer from another failing —poor catalyst/regeneration gas contact. Much of the regeneration gas passes through the bed in the form of large bubbles, making only poor contact with catalyst in the bed. Much of the bed is stagnant.

Afterburning is a significant problem with these units, as the large bubbles of regeneration air can contact CO in the dilute phase region, and cause further combustion to $CO_2$. This is problematic due to the metallurgical limits of the cyclones. Addition of large amounts of Pt can greatly reduce or eliminate afterburning, but such usage will increase $NO_x$ emissions.

We studied these regenerators, and realized there was a way to make virtues of their defects. The very properties which made them difficult to work with (poor gas contacting and vapor bypassing, afterburning and poor catalyst circulation) provided a framework for a better regenerator design. We could make minor equipment modifications to achieve significant process benefits involving essentially no operating expense. We found a way to use afterburning productively, to reduce average bed temperature and reduce hydrothermal deactivation of catalyst. We were also able to reduce $NO_x$ emissions associated with such units.

BRIEF SUMMARY OF THE INVENTION

Accordingly the present invention provides a process for the catalytic cracking of a nitrogen containing hydrocarbon feed to lighter products comprising: cracking said feed by contacting said feed with a supply of hot, regenerated cracking catalyst in a fluidized catalytic cracking (FCC) reactor means operating at catalytic cracking conditions to produce a mixture of cracked products and spent cracking catalyst containing coke and nitrogen compounds; separating said cracked products and spent cracking catalyst containing coke and nitrogen compounds to produce a cracked product vapor phase which is charged to a fractionation means and a spent catalyst phase; stripping said spent catalyst in a stripping means to produce a stripped catalyst phase containing coke and nitrogen compounds; dense phase fluidized bed regeneration of said spent cracking catalyst in a catalyst regeneration means by contact with oxygen or an oxygen-containing gas at dense phase fluidized bed catalyst regeneration conditions sufficient to produce a flue gas containing $NO_x$ and having a CO content of at least 1.0 mole % which is discharged up from said dense phase fluidized bed into a dilute phase region above, and said regeneration conditions include a superficial vapor velocity sufficient to entrain at least a portion of the catalyst in said fluidized bed into said dilute phase region; dilute phase afterburning of CO in said dilute phase region by contact with an oxygen containing gas to produce $CO_2$ and heat, in an amount sufficient to superheat catalyst entrained in flue gas by direct contact heat exchange by at least 10 F, and wherein sufficient CO is burned so that the flue gas composition, after afterburning, has a $CO_2$/CO mole ratio of at least 10:1; cyclonically separating, in a plurality of cyclone separation means having dipleg means, said superheated catalyst from said flue gas to produce a flue gas stream which is removed from said regenerator and a recovered superheated catalyst stream which is collected in said diplegs; discharging at least a majority by weight of the superheated catalyst collected in said cyclone diplegs into a regenerated catalyst withdrawal means having a regenerated catalyst inlet associated with said regenerator vessel and a regenerated catalyst outlet connective with said FCC reactor, and wherein the $NO_x$ content of the flue gas withdrawn from said cyclone separation means is reduced at least 10% as compared to operation wherein said cyclone diplegs discharge catalyst straight down into the dense phase fluidized bed.

In another embodiment, the present invention provides a process for the catalytic cracking of a hydrocarbon feed to lighter products and reduced temperature regeneration of a cracking catalyst comprising: cracking said feed by contacting said feed with a supply of hot, regenerated cracking catalyst in a fluidized catalytic cracking (FCC) reactor means operating at catalytic cracking conditions to produce a mixture of cracked products and spent cracking catalyst containing coke; separating said cracked products and spent cracking catalyst containing coke to produce a cracked product vapor phase which is charged to a fractionation means and a spent catalyst phase; stripping said spent catalyst in a stripping means to produce a stripped catalyst phase containing coke; dense phase, bubbling fluidized bed regeneration of said spent cracking catalyst in a catalyst regeneration means by contact with oxygen or an oxygen-containing gas at dense phase bubbling fluidized bed catalyst regeneration conditions including a temperature of 1200 to 1350 F and a superficial vapor velocity of 0.5 to 5.0 fps to produce a flue gas having an oxygen content of at least 1.0 mole % and a CO content of at least 1.0 mole % and entrained catalyst which is discharged up from said dense phase bubbling fluidized bed into a dilute phase region above; dilute phase afterburning of at least 90% of said CO in said dilute phase region by contact with oxygen and superheating entrained catalyst by direct contact heat exchange at least 25 F; cyclonically separating, in a plurality of primary cyclone separation means having primary cyclone dipleg means, said superheated catalyst from said flue gas to produce a flue gas stream which is passed through secondary cyclones and is removed from said regenerator and a recovered superheated catalyst stream which is discharged via said primary cyclone diplegs; discharging at least 90% by weight of the superheated catalyst from said primary cyclone diplegs into a regenerated catalyst withdrawal means having a regenerated catalyst inlet immersed within said bubbling dense bed in said regenerator vessel; and recycling to said cracking reactor regenerated catalyst withdrawn from said bubbling dense bed and said superheated catalyst discharged from said primary cyclone diplegs.

In an apparatus embodiment, the present invention provides an apparatus for the fluidized bed regeneration of fluidized cracking catalyst comprising: a regenerator vessel; a riser reactor having a base inlet for a heavy crackable feed and having an inlet for regenerated catalyst withdrawn from said regenerator and connected to said reactor, and an outlet in an upper portion thereof for cracked vapor products and spent catalyst; a reactor vessel connected to said regenerator vessel, receiving and separating said cracked vapor products and spent catalyst discharged from said riser reactor, and having an outlet in an upper portion thereof for vapor and a spent catalyst outlet in a lower portion thereof for spent catalyst; a catalyst stripper, beneath said reactor vessel, having an inlet in an upper portion thereof for spent catalyst discharged from and connected to said spent catalyst outlet of said reactor vessel, an inlet for stripping gas in a lower portion thereof, and an outlet in a lower portion thereof for stripped catalyst; a stripped catalyst transfer means having an inlet connected to said stripped catalyst outlet of said catalyst stripper and an outlet connected to said regenerator vessel; said catalyst regenerator vessel having: an inlet for spent catalyst connected to said stripped catalyst transfer means, an inlet for regeneration gas in a lower portion thereof, a conduit outlet, in a lower portion of said regenerator vessel, having a conduit outlet diameter connected to said inlet for regenerated catalyst of said riser reactor, and a plurality of cyclone separation means having an inlet horn or horns in an upper portion of said regenerator vessel for receiving flue gas and entrained catalyst discharged up from said lower portion of said vessel; said cyclone separation means having dipleg means discharging recovered entrained catalyst down within a radius of one conduit outlet diameter of said conduit outlet.

BRIEF DESCRIPTION OF THE DRAWINGS

FIG. 2 (prior art) is a view of the conventional regenerator shown in FIG. 1, with all 16 cyclones shown.

FIG. 3 (invention) is a view of a regenerator of the invention, with both primary and secondary cyclone diplegs bent to discharge catalyst into the bathtub.

FIG. 4 (invention) is a view of a regenerator of the invention with only primary cyclone diplegs above the bathtub.

FIGS. 2A–4A are plan views of FIGS. 2–4, respectively.

DETAILED DESCRIPTION

Figure 1:
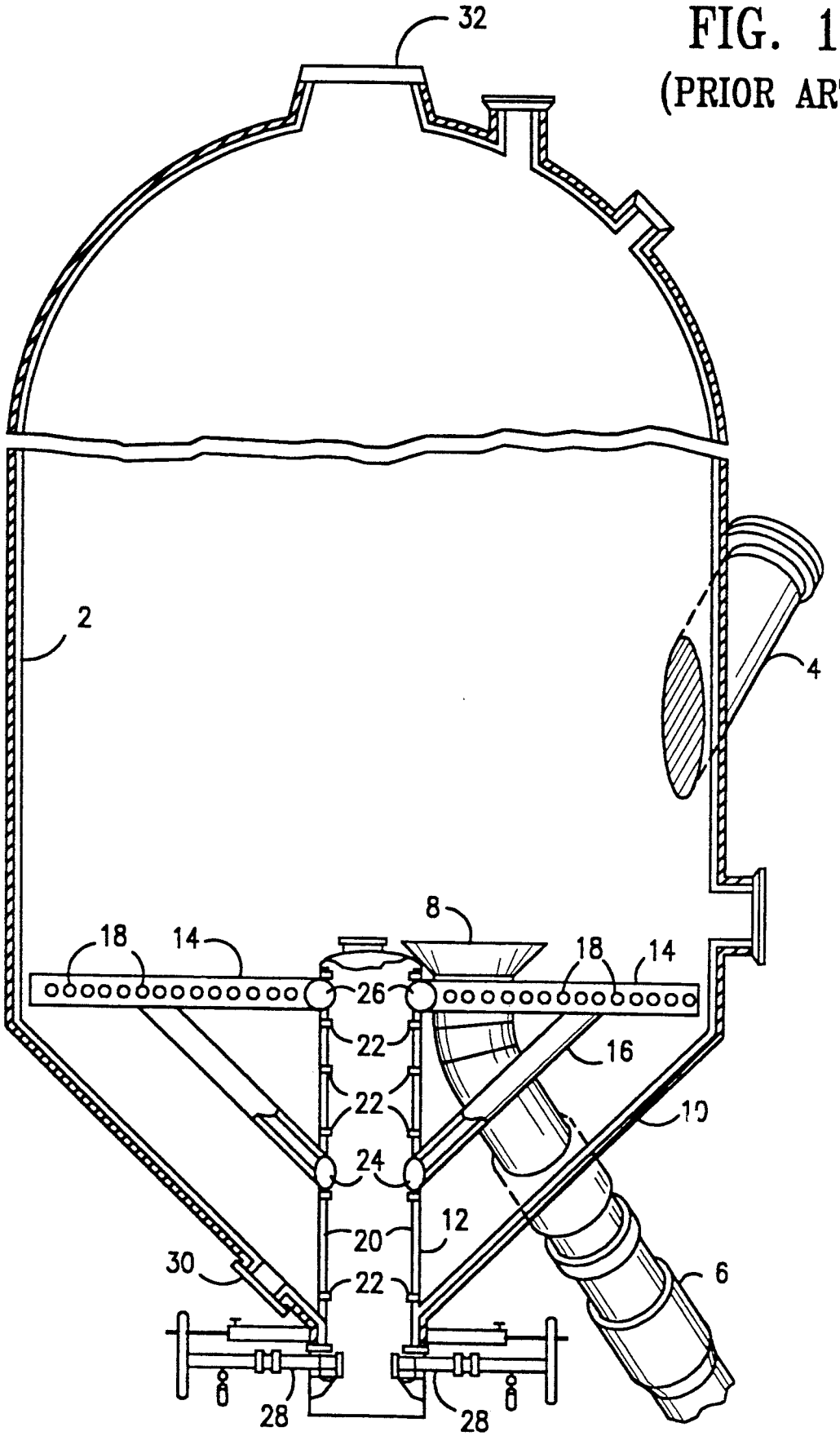
FIG. 1 (PRIOR ART)
FIG. 1 (prior art) is a simplified elevation view of a conventional FCC unit with a swirl regenerator, taken from U.S. Pat. No. 4,994,424.

The process of the present invention is an integral part of the catalytic cracking process. The essential elements of this process will be briefly reviewed in conjunction with a review of FIGS. 1 and 2 (both prior art). Additional details such as FCC reactor systems and spent catalyst strippers are disclosed in most of the patents incorporated by reference. U.S. Pat. No. 3,900,548 shows a swirl regenerator, and how it ties in to an FCC reactor and stripper, and this patent is also incorporated by reference.

FIG. 1 (Prior Art—from U.S. Pat. No. 4,994,424) shows in elevation a regeneration vessel 2 comprising a regeneration gas distributor means with a flow control valve means. To simplify the drawing, cyclones and diplegs are not shown. A tangential catalyst inlet 4 introduces spent catalyst to vessel 2. Conduit 6 extending up into the vessel and terminating in a funnel shaped mouth 8 above the distributor grid provides means for withdrawing regenerated catalyst. A regeneration gas inlet conduit 12 extends up through the conical bottom 10. A plurality of conduit means 14 extend substantially horizontally outwardly to provide a grid means. Support conduits 16 in open communication with conduits 12 and 14 provide structural support to the grid and distribute regeneration gas. Pipe means 18 extend at right angles to conduits 14. Vertical rods 20 retained by bearings 22 adjacent the inner wall of manifold pipe 12 are provided with disc shape plates 24 and 26 which are valve means for adjusting the flow of gases from manifold 12 into either conduit 14 or 16. The bottom end of each rod is provided with a gear in matching engagement with a work gear on the end of an adjusting rod 28 extending through the wall of inlet pipe 12 external to conical bottom 10. The adjusting rod has a hand wheel on the outside. A covered manhole 30 is provided in the lower portion of the conical bottom 10.

Regeneration gas enters via conduit 12 and passes through conduits 16 and 14 to distributor pipes 18, then passes out through holes along the bottom surface of the pipes and then up through a bed of catalyst to be regenerated under fluid phase regeneration conditions. Regenerated catalyst is withdrawn by conical inlet 8 communicating with conduit 6. Regeneration gas after passing through suitable cyclone separators not shown and positioned in an upper portion of the regenerator passes into a plenum chamber not shown and then out the top of the regenerator vessel as by opening 32.

FIG. 2 (prior art) shows how conjested a typical FCC regenerator with cyclones. All FCC regenerators are similar in this regard, i.e., they contain a large number of primary and secondary, and rarely third stage, cyclones. The FIG. 2 regenerator happens to be a swirl type regenerator.

Regenerator 200 receives spent catalyst via spent catalyst inlet 210 and regeneration air inlet 205. Regenerated catalyst is withdrawn via bathtub 225 and catalyst outlet line 220 for reuse in the cracking reactor. A mixture of flue gas and entrained catalyst rises from a bubbling dense phase fluidized bed of catalyst in the lower ⅓ or so of the regenerator vessel, to enter 8 primary cyclones 250. The primary cyclones will usually recover more than 90% of the entrained catalyst, which is returned via diplegs 255, sealed by immersion in the fluidized bed. Flue gas and remaining entrained catalyst and some fines pass into second stage cyclones 260, which recover essentially all of the entrained catalyst to produce a flue gas stream which is removed via line 230. Recovered catalyst is discharged from the second stage cyclones via diplegs 265.

FIG. 2A, a plan view, shows the radial distribution of the 8 primary cyclones 250, and their connection with the 8 secondary cyclones 260.

FIG. 3 (Invention) is very similar in all respects to FIG. 2 save for the cyclone diplegs. Drawing elements differ by 100 from the FIG. 2 embodiment, e.g., spent catalyst is added via inlet 310 in FIG. 3 and via inlet 210 in FIG. 2.

The FIG. 3 primary and secondary cyclone diplegs, 355 and 365 respectively, are bent as necessary to discharge recovered catalyst above the bathtub 325 for return to the cracking reactor via line 320. FIG. 3A shows a plan view.

FIG. 4 (Invention) shows a preferred embodiment, which is much easier to implement in most refineries. As the primary cyclones recover over 90%, and usually over 99% of the entrained catalyst, essentially all of the benefits of the invention can be achieved by discharging into the catalyst return line only catalyst recovered from the primary cyclones. Thus the primary cyclone 450 discharge recovered catalyst into primary cyclone diplegs 455 which are oriented to discharge catalyst into the bathtub 425. The secondary cyclone diplegs 465 can simply be left alone, or bent as needed to provide additional space for re-routed primary cyclone diplegs.

Although discussed in terms of an Orthoflow and swirl type regenerator, the present invention is an improvement for use in any catalytic cracking unit which uses a catalyst regenerator operating with a significant amount of dilute phase afterburning. Most bubbling dense bed regenerators operating in full CO combustion mode will, or can easily be made to have, dilute phase afterburning. The invention is most useful in conjunction with the conventional all riser cracking FCC units, such as disclosed in U.S. Pat. No. 4,421,636, incorporated by reference.

FCC FEED

Any conventional FCC feed can be used. The process of the present invention is useful for processing nitrogenous charge stocks, those containing more than 500 ppm total nitrogen compounds, and especially useful in processing stocks containing very high levels of nitrogen compounds, such as those with more than 1000 wt ppm total nitrogen compounds.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The present invention is most useful with feeds having an initial boiling point above about 650 F.

FCC CATALYST

Commercially available FCC catalysts may be used. The catalyst must contain relatively large amounts of large pore zeolite for maximum effectiveness, but such catalysts are readily available.

Preferred catalysts for use herein will usually contain at least 10 wt % large pore zeolite in a porous refractory matrix such as silica-alumina, clay, or the like. The zeolite content is preferably much higher than this, and should usually be at least 20 wt % large pore zeolite. For optimum results, the catalyst should contain from 30 to 60 wt % large pore zeolite.

All zeolite contents discussed herein refer to the zeolite content of the makeup catalyst, rather than the zeolite content of the equilibrium catalyst, or E-Cat. Much crystallinity is lost in the weeks and months that the catalyst spends in the harsh, steam filled environment of modern FCC regenerators, so the equilibrium catalyst will contain a much lower zeolite content by classical analytic methods. Most refiners usually refer to the zeolite content of their makeup catalyst, and the MAT (Modified Activity Test) or FAI (Fluidized Activity Index) of their equilibrium catalyst, and this specification follows this naming convention.

Conventional zeolites such as X and Y zeolites, or aluminum deficient forms of these zeolites such as dealuminized Y (DEAL Y), ultrastable Y (USY) and ultrahydrophobic Y (UHP Y) may be used as the large pore cracking catalyst. The zeolites may be stabilized with Rare Earths, e.g., 0.1 to 10 wt % RE.

Relatively high silica zeolite containing catalysts are preferred for use in the present invention. They withstand the high temperatures usually associated with complete combustion of CO to $CO_2$ within the FCC regenerator. Catalysts containing 30–60% USY or rare earth USY (REUSY) are especially preferred.

The catalyst inventory may also contain one or more additives, either present as separate additive particles, or mixed in with each particle of the cracking catalyst. Additives can be added to enhance octane (medium pore size zeolites, sometimes referred to as shape selective zeolites, i.e., those having a Constraint Index of 1–12, and typified by ZSM-5, and other materials having a similar crystal structure).

The FCC catalyst composition, per se, forms no part of the present invention.

CO COMBUSTION PROMOTER

Use of a CO combustion promoter in the regenerator or combustion zone is not essential for the practice of the present invention, however, some may be present. These materials are well-known.

U.S. Pat. Nos. 4,072,600 and 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit.

We usually will prefer to operate with modest amounts of CO combustion additive. Operation with too much promoter, e.g., 5 or 10 wt ppm Pt (or considerably more or less depending on the unit) can eliminate dilute phase afterburning, which is beneficially used in the process of the present invention to reduce the temperature in the bubbling dense bed.

$SO_x$ ADDITIVES

Additives may be used to adsorb $SO_x$. These are believed to be primarily various forms of alumina, rare-earth oxides, and alkaline earth oxides, containing minor amounts of Pt, on the order of 0.1 to 2 ppm Pt. Additives for removal of $SO_x$ are available from several catalyst suppliers, such as Davison's "R" or Katalistiks International, Inc.'s "DESOX."

FCC REACTOR CONDITIONS

Conventional riser cracking conditions may be used. Typical riser cracking reaction conditions include catalyst/oil ratios of 0.5:1 to 15:1 and preferably 3:1 to 8:1, and a catalyst contact time of 0.1–50 seconds, and preferably 0.5 to 10 seconds, and most preferably about 0.75 to 5 seconds, and riser top temperatures of 900 to about 1050 F.

It is important to have good mixing of feed with catalyst in the base of the riser reactor, using conventional techniques such as adding large amounts of atomizing steam, use of multiple nozzles, use of atomizing nozzles and similar technology.

It is preferred, but not essential, to have a riser catalyst acceleration zone in the base of the riser.

It is preferred, but not essential, to have the riser reactor discharge into a closed cyclone system for rapid and efficient separation of cracked products from spent catalyst. A preferred closed cyclone system is disclosed in U.S. Pat. No. 4,502,947 to Haddad et al, which is incorporated by reference.

It is preferred but not essential, to rapidly strip the catalyst just as it exits the riser, and upstream of the conventional catalyst stripper. Stripper cyclones disclosed in U.S. Pat. No. 4,173,527, Schatz and Heffley, incorporated by reference, may be used.

It is preferred, but not essential, to use a hot catalyst stripper. Hot strippers heat spent catalyst by adding some hot, regenerated catalyst to spent catalyst. Suitable hot strippers are shown in U.S. Pat. No. 3,821,103, Owen et al, incorporated by reference. If hot stripping is used, a catalyst cooler may be used to cool the heated catalyst before it is sent to the catalyst regenerator. A preferred hot stripper and catalyst cooler is shown in U.S. Pat. No. 4,820,404, Owen, which is incorporated by reference.

The FCC reactor and stripper conditions, per se, can be conventional.

CATALYST REGENERATION

The process and apparatus of the present invention can use conventional FCC regenerators. The process and modifications to make the apparatus, will be most useful when applied to swirl or cross flow regenerators, or to the regenerators associated with Orthoflow or stacked FCC units.

Swirl regenerators are disclosed in U.S. Pat. No. 4,490,241, Chou, and U.S. Pat. No. 4,994,424 Leib and Sapre, which are incorporated by reference.

A cross-flow regenerator is disclosed in U.S. Pat. No. 4,980,048 Leib and Sapre, which is incorporated by reference.

A regenerator associated with a stacked or Orthoflow type FCC unit is disclosed in U.S. Pat. Nos. 5,032,252 and 5,043,055 Owen and Schipper, which are incorporated by reference.

Most FCC regenerators with a single bubbling dense phase fluidized bed of catalyst in the regenerator operate with large amounts of catalyst, because the bubbling bed regenerators are not very efficient at burning coke, hence a large inventory and long residence time in the regenerator were needed to get clean burned catalyst. Many units contain several hundred tons of catalyst. Mean catalyst residence time in such regenerators is typically 1–10 minutes, with most having catalyst residence times of 2–3 minutes.

The regenerators would preferably be operated with some degree of dilute phase afterburning, at least 10 F, and preferably at least 20 F, more preferably at least 25 F and most preferably with 40 to 150 F of afterburning intermediate the bubbling dense bed and the cyclones. The regenerators should be operated to maintain complete CO combustion, so that at least 90 % of the carbon in the flue gas is in the form of $CO_2$ and less than 10% is in the form of CO.

Even if no afterburn is present, the present invention can achieve some $NO_x$ reduction because the dilute phase catalyst is hotter than the dense phase catalyst and this hotter catalyst is selectively removed from the vessel. We prefer to operate in substantially complete CO combustion mode. This will require fairly close monitoring of the unit, and control of the amount of CO combustion promoter present. Excess promotion, and reduced or negative temperature rises in the dilute phase should be avoided.

At least 90% of the CO formed in the regenerator should be burned to $CO_2$ within the regenerator, so that the flue gas contains only limited amounts of CO. The CO content of the flue gas should be below 10 volume %, is preferably below 1 volume %, more preferably below 100 ppm and most preferably below 10 ppm.

The oxygen content of the flue gas leaving the regenerator will usually be at most 3 volume %, and preferably at most 2 volume %, more preferably at most 1 volume %, and most preferably at most 0.5 volume %.

The temperature of regenerated catalyst and of flue gas leaving the regenerator will be about the same as in prior art units, however the bed temperature will be substantially less.

The process of the present invention can reduce the bed temperature, while keeping the flue gas and regenerated catalyst temperature up, by forcing the dilute phase afterburning to do some useful work. In the process of the present invention, afterburning is permitted and encouraged, as is catalyst entrainment into the dilute phase, so that the heat of afterburning is transferred into catalyst in the dilute phase. This happened in prior art regenerators too, but in our design and process we selectively discharge the catalyst recovered from the cyclones so that at least a majority of it is deposited into or near the regenerated catalyst outlet. Preferably at least 90 % of the catalyst recovered from the dilute phase region via cyclone separators is discharged from the cyclone diplegs into, or near enough to, the regenerated catalyst outlet so that the catalyst discharged from the cyclones is removed within less than 1 minute.

In most bubbling dense bed regenerators there is sufficient entrainment of catalyst into the dilute phase so that every 5 to 50 minutes an amount of catalyst equal to the inventory of catalyst in the bubbling dense bed passes through the cyclones. This is a tremendous amount of catalyst circulation, which heretofore performed no useful work, but now permits an extra stage of regeneration to be achieved in the dilute phase.

The superheated catalyst recovered in the cyclones is selectively returned to the cracking reaction, so that none of the heat of combustion is lost. The dense bed operates at a cooler temperature, because more of the heat release occurs in the dilute phase above the bed, rather than in the bed. In prior art units, the cyclone diplegs (there were frequently 6 to 24) simply dumped the catalyst straight down the cyclone dipleg back into the bubbling dense bed, heating the entire dense bed rather than merely returning the catalyst to the reactor.

EXAMPLES

A series of computer simulations were run to determine the changes in bed temperature that would occur if the cyclone diplegs were bent or rerouted so that catalyst discharged from them went preferentially into the regenerated catalyst outlet rather than being dumped back into the bubbling dense bed.

The computer simulation used is a reliable predictor of what occurs in commercial units. In many ways the computer simulation results are more reliable than actual commercial test data, because there is so much scatter associated with commercial FCC units. Results are presented in Table 1.

SIMULATION 1 (Prior Art)

Computer Simulation 1 is a base case or prior art case operating in complete CO combustion mode to produce a clean burned catalyst, one with less than about 0.5 wt % coke, in a bubbling dense bed type regenerator. (Base Case)

SIMULATION 2

Computer Simulation 1 was repeated, but modified to reflect discharge of roughly 100% of catalyst recovered from cyclone diplegs to the regenerated catalyst outlet. (Piped to Outlet)

TABLE 1

| | Base Case | Diplegs Piped to Outlet |
|---|---|---|
| Bed Inventory, tons | 133 | 133 |
| Bed Diameter, feet | 37 | 37 |
| Catalyst Bed Height, ft. | 10 | 10 |
| Catalyst to Riser Temp, °F. | 1309 | 1309 |
| Dense Bed Temp, °F. | 1309 | 1276 |
| Upper Dilute Phase Temp, °F. | 1331 | 1299 |
| Flue Gas Temp, °F. | 1356 | 1348 |
| Flue Gas Rate, MSCFM | 154 | 154 |
| Catalyst Circulation, TPM | 26.2 | 26.2 |
| $CO_2$, mol % | 15.7 | 15.7 |
| Excess Oxygen, mol % | 0.56 | 0.54 |
| $NO_x$ in Flue Gas, ppm | 100 | 69.2 |
| Carbon on spent, wt % | 1.66 | 1.66 |
| Carbon on regen cat, wt % | .08 | .07 |
| Catalyst Makeup, TPD | 13.9 | 12.8 |

DISCUSSION

The process of the present invention allows useful work to be performed by afterburning in the dilute phase region above a bubbling dense bed regenerator. Recycling to the cracking reactor catalyst obtained from the regenerator cyclone diplegs will, in a heat balanced unit, force the cyclone temperature to that required for the regenerated catalyst, or an approach thereto if some catalyst is withdrawn from the bed and some withdrawn from the cyclone diplegs. This allows lower temperatures to prevail in the bed down below.

If necessary, catalyst entrainment can be increased by increasing vapor velocity in the dilute phase (narrowing the regenerator vessel ID at or below the inlet horns of the cyclones, lowering the cyclone inlets, or tying together the inlet horns to the cyclone separators, and lowering the combined inlet nearer to the dense bed.

In the computer simulation above, the dense bed temperature was reduced about 30 F, which is a significant reduction. The amount of hydrothermal catalyst deactivation occurring will be greatly reduced, leading to somewhat extended catalyst life, or a reduced need for makeup catalyst as shown in Table 1. The lower temperatures will reduce $NO_x$ emissions. The somewhat more reducing atmosphere in the bubbling dense bed should also reduce $NO_x$ emissions somewhat. The lower temperatures, and somewhat reducing conditions prevailing in the bubbling bed should also reduce somewhat the formation of highly oxidized forms of vanadium, thus providing some protection against formation of vanadic acid, which can attack zeolite structure.

The process of the present invention can be readily used in many existing FCC regenerators with only minor modifications to the unit. The units all have cyclones now, and cyclone diplegs. It usually will not be possible, or beneficial, to move the cyclones, rather the cyclone diplegs can be angled so as to discharge directly into, over, or near the regenerated catalyst outlet, so that the cyclone diplegs are in fluid communication with the regenerated catalyst outlet and bypass a majority of the bubbling dense bed of catalyst.

In typical FCC regenerators the primary cyclones capture and return to the dense bed 99% or more of the solids which enter them while the secondary cyclones handle only 1% or less of the total solids. Hence most of the benefit of the present invention may be realized by rerouting the diplegs of the primary cyclones only.

In many FCC regenerator vessels the flue gas from the cyclones discharges to a common plenum in the center of the top head, requiring the secondary cyclones to occupy the center or near-center positions in the vessel while the primary cyclones are located around the outer wall of the vessel. Since the catalyst outlet is typically at one side of the vessel, the diplegs of at least a few of the primary cyclones must be angled across a large fraction of the vessel diameter. This is feasible as long as the resulting dipleg angle is not less than the angle of repose of the catalyst. (The angle of repose is the acute angle formed with the horizontal by an unconstrained conical pile of the solids). If the diplegs cannot reach the catalyst outlet in the height available without forming an angle less than the angle of repose, they should be piped at just greater than the angle of repose to a point as close as possible to the outlet. As an alternative realization of the present invention, the primary cyclones may be located at the center or near-center positions in the vessel with the secondary cyclones at the outer wall, which will typicaly allow all primary cyclone diplegs to be angled the full distance to the catalyst outlet within the angle of repose constraint. However, some extra piping will be required to route the vapor outlets from the secondary cyclones to a common plenum or header.

The present invention realizes some of the benefits of a High Efficiency Regenerator (H.E.R.) design. The latter consists of a coke combustor, a dilute phase transport riser, and a second dense bed at a higher temperature than the combustor, with recycle of some hot regenerated catalyst from the second dense bed to the combustor. Units of this type are shown in U.S. Pat. No. 3,926,778 and other recent patents. By routing the cyclone diplegs to the catalyst outlet the present invention establishes a catalyst flow path and temperature history quite similar to an H.E.R. unit: combustion occurs in a dense bed and continues in a dilute phase, the hottest catalyst exiting the dilute phase being returned to the riser. The recycle of some hot catalyst in an H.E.R. unit is required to maintain a sufficiently high temperture in the coke combustor; this is not necessary in applying the present invention to a swirl or crossflow regenerator. Like an H.E.R. unit, the present invention achieves lower $NO_x$ production and combusts at a lower average bed temperature than an unmodified swirl or crossflow unit.

We claim:

1. A process for the catalytic cracking of a nitrogen containing hydrocarbon feed to lighter products comprising:

a. cracking said feed by contacting said feed with a supply of hot, regenerated cracking catalyst in a fluidized catalytic cracking (FCC) reactor means operating at catalytic cracking conditions to produce a mixture of cracked products and spent cracking catalyst containing coke and nitrogen compounds;

b. separating said cracked products and spent cracking catalyst containing coke and nitrogen compounds to produce a cracked product vapor phase which is charged to a fractionation means and a spent catalyst phase;

c. stripping said spent catalyst in a stripping means to produce a stripped catalyst phase containing coke and nitrogen compounds;

d. regenerating, in a dense phase fluidized bed said spent cracking catalyst in a catalyst regeneration means by contact with oxygen or an oxygen-containing gas at bubbling dense phase fluidized bed catalyst regeneration conditions sufficient to produce a flue gas containing $NO_x$ and having a CO content of at least 1.0 mole % which is discharged up from said dense phase fluidized bed into a dilute phase region above, and said regeneration conditions include a superficial vapor velocity sufficient to entrain at least a portion of the catalyst in said fluidized bed into said dilute phase region;

e. afterburning CO in said dilute phase region by contact with an oxygen containing gas to produce $CO_2$ and heat, in an amount sufficient to superheat catalyst entrained in flue gas by direct contact heat exchange by at least 10 F, and wherein sufficient CO is burned so that the flue gas composition, after afterburning, has a $CO_2$/CO mole ratio of at least 10:1;

f. cyclonically separating, in a plurality of cyclone separation means having dipleg means, said superheated catalyst from said flue gas to produce a flue gas stream which is removed from said regenerator and a recovered superheated catalyst stream which is collected in said diplegs;

g. discharging at least a majority by weight of the superheated catalyst collected in said cyclone diplegs into a regenerated catalyst withdrawal means having a regenerated catalyst inlet associated with said regenerator vessel and a regenerated catalyst outlet connective with said FCC reactor, and wherein the $NO_x$ content of the flue gas withdrawn from said cyclone separation means is reduced at least 10% as compared to operation wherein said cyclone diplegs discharge catalyst straight down into the dense phase fluidized bed.

2. The process of claim 1 wherein the regenerator is a bubbling dense bed regenerator operating at a bed temperature of 1200 to 1400 F, the superficial vapor velocity in said bed is 0.5 to 5.0 fps, and sufficient oxygen containing gas is added to produce a flue gas discharged from said bubbling dense bed into said dilute phase region containing 0.5 to 1.0% CO, and 1.0 to 2.0% oxygen, and sufficient CO combustion occurs in the dilute phase region to superheat said entrained catalyst at least 30 F.

3. The process of claim 1 wherein said cyclones comprise a plurality of primary cyclones having one or more inlet horns within said dilute phase region, primary cyclone diplegs and primary cyclone vapor outlets, and wherein said primary cyclone vapor outlets are connective with a plurality of secondary cyclones, and wherein a single regenerated catalyst withdrawal outlet having a diameter is immersed within said dense phase fluidized bed, and wherein all of said primary cyclone diplegs discharge above or within one diameter to the side of said catalyst withdrawal outlet.

4. The process of claim 3 wherein the catalyst withdrawal outlet is a bathtub and said primary cyclone diplegs discharge catalyst into said bathtub.

5. The process of claim 1 wherein at least 90% by weight of catalyst recovered in the cyclones and discharged via the cyclone diplegs bypasses said dense phase bed and is removed from said regenerator means within 1 minute of discharge from said cyclone diplegs.

6. The process of claim 5 wherein the dense phase fluidized bed operates at an average bed temperature at least 30 F below the temperature of catalyst withdrawn from said regenerator means and recycled to said cracking reactor.

7. The process of claim 1 wherein the dense phase fluidized bed operates at bubbling fluidized bed conditions.

8. The process of claim 1 wherein the dense phase fluidized bed operates at turbulent fluidized bed conditions.

9. The process of claim 3 wherein said primary cyclone diplegs discharge within one outlet diameter of said catalyst outlet and said secondary cyclones discharge recovered catalyst via secondary cyclone diplegs straight down into the dense phase fluidized bed.

10. A process for the catalytic cracking of a hydrocarbon feed to lighter products and reduced temperature regeneration of a cracking catalyst comprising a. cracking said feed by contacting said feed with a supply of hot, regenerated cracking catalyst in a fluidized catalytic cracking (FCC) reactor means operating at catalytic cracking conditions to produce a mixture of cracked products and spent cracking catalyst containing coke;

b. separating said cracked products and spent cracking catalyst containing coke to produce a cracked product vapor phase which is charged to a fractionation means and a spent catalyst phase;

c. stripping said spent catalyst in a stripping means to produce a stripped catalyst phase containing coke;

d. regenerating, in a dense phase fluidized bed said spent cracking catalyst in a catalyst regeneration means by contact with oxygen or an oxygen-containing gas at dense phase bubbling fluidized bed catalyst regeneration conditions including a temperature of 1200 to 1350 F and a superficial vapor velocity of 0.5 to 5.0 fps to produce a flue gas having an oxygen content of at least 1.0 mole % and a CO content of at least 1.0 mole % and entrained catalyst which is discharged up from said dense phase bubbling fluidized bed into a dilute phase region above;

e. afterburning at least 90% of said CO in said dilute phase region by contact with oxygen and superheating entrained catalyst by direct contact heat exchange at least 25 F;

f. cyclonically separating, in a plurality of primary cyclone separation means having primary cyclone dipleg means, said superheated catalyst from said flue gas to produce a flue gas stream which is passed through secondary cyclones and is removed from said regenerator and a recovered superheated catalyst stream which is discharged via said primary cyclone diplegs;

g. discharging at least 90% by weight of the superheated catalyst from said primary cyclone diplegs into a regenerated catalyst withdrawal means having a regenerated catalyst inlet immersed within said bubbling dense bed in said regenerator vessel; and h. recycling to said cracking reactor regenerated catalyst withdrawn from said bubbling dense bed and said superheated catalyst discharged from said primary cyclone diplegs.

11. The process of claim 10 wherein at least a majority of the catalyst withdrawn from said regeneration means and charged to said cracking reactor means is recovered from said primary cyclone diplegs.

12. The process of claim 10 wherein essentially all of the superheated catalyst withdrawn from said primary cyclone diplegs is discharged into said catalyst withdrawal means immersed in said bubbling dense bed.

13. The process of claim 10 wherein a single regenerated catalyst withdrawal outlet having a diameter is immersed within said dense phase fluidized bed, and wherein all of said primary cyclone diplegs discharge above or within one outlet diameter to the side of said catalyst withdrawal outlet.

14. The process of claim 13 wherein said catalyst withdrawal outlet is a bathtub and said primary cyclone diplegs discharge catalyst into said bathtub.

15. The process of claim 10 wherein at least 90% by weight of catalyst recovered via said primary cyclone diplegs bypasses said dense phase bed and is removed from said regenerator means within 1 minute of discharge from said cyclone diplegs.

16. The process of claim 10 wherein the dense phase fluidized bed operates at an average bed temperature at least 30 F below the temperature of catalyst withdrawn from said regenerator means and recycled to said cracking reactor.

17. The process of claim 10 wherein the temperature of catalyst discharge via said primary cyclone diplegs is at least 50 F above the average dense bed temperature.

* * * * *